US005313691A

United States Patent [19]

Hashimoto

[11] Patent Number: 5,313,691

[45] Date of Patent: May 24, 1994

[54] BUCKLE FOR WATCH BANDS

[75] Inventor: Norio Hashimoto, Tanashi, Japan

[73] Assignee: Citizen Watch Company, Tokyo, Japan

[21] Appl. No.: 42,781

[22] Filed: Apr. 6, 1993

[30] Foreign Application Priority Data

Apr. 24, 1992 [JP] Japan ..... 4-34415
Sept. 29, 1992 [JP] Japan ..... 4-73286

[51] Int. Cl.[5] ..... A44C 5/00

[52] U.S. Cl. ..... 24/69 J; 24/71 J; 24/265 WS; 24/656

[58] Field of Search ..... 24/68 J, 68 R, 71 J, 24/69 J, 265 WS, 589, 656, 583, 685

[56] References Cited

U.S. PATENT DOCUMENTS 2,453,993 11/1948 Kreisler ..... 24/265 WS
3,665,565 5/1972 Kruger ..... 24/265 WS
4,382,318 5/1983 Takimoto ..... 24/71 J
4,675,955 6/1987 Nakamura ..... 24/656
4,928,359 5/1990 Gagnebin ..... 24/71 J
5,191,685 3/1993 Aoki et al. ..... 24/68 J

FOREIGN PATENT DOCUMENTS 00899687 6/1967 France ..... 24/265 WS
0454215 5/1992 Japan .

*Primary Examiner*—Victor N. Sakran
*Attorney, Agent, or Firm*—John T. Roberts

[57] ABSTRACT

A buckle for a watch band has a housing connected to the watch band, a pair of push plates provided in the housing so as to be moved in a lateral direction, and a pair of springs for urging the push plates. A pair of stopper pins are provided for stopping the push plates urged by the springs. A cover having a lock pin is pivotally connected to an end of the housing. The cover is provided such that the lock pin is inserted into an opening of the housing and engaged with hooks of the push plates. An opening spring is provided between the housing and the cover for urging the cover to an open position.

9 Claims, 6 Drawing Sheets

BUCKLE FOR WATCH BANDS

BACKGROUND OF THE INVENTION

The present invention relates to a buckle for a watch band, and more particularly to a buckle having a lock mechanism and a pair of push plates for releasing the locking of the buckle by the lock mechanism.

Japanese Utility Model Application Laid-open No. 4-54215 discloses a buckle for a watch band. FIGS. 10 to 12 show the buckle. The buckle comprises an engaging member 20 and a rotatable clasping member 21 rotatably mounted on an end of the engaging member 20. The engaging member 20 comprises a frame member 26, a first operating member 22 as a lock lever, and a second operating member 23 as a pressing-up lever. The rotatable clasping member 21 comprises a cover plate 24 rotatably engaged with the frame member 26, and an engaging plate 25 projecting from the underside of the cover plate. The engaging plate 25 comprises a downward slant 25*a*, a hook portion 25*b* and a spherical projection 25*c*.

As shown in FIG. 11, the first and second operating members 22 and 23 are slidably mounted in the frame member 26 so as to be moved in the lateral direction with respect to the longitudinal direction of the band (not shown), and outwardly urged by a spring 28. Two stopper pins 26*b* are provided, each of which is slidably engaged with a slit of the operating member 22 (23) so as to prevent the member from removing from the frame member 26. The inner end portions of the first and second operating members are partially overlapped with each other. The first operating member 22 has a lock portion 22*a*. The second operating member 23 has an upward slant 23*a* as a pressing-up slant to be abutted on the downward slant 25*a* of the engaging plate 25.

Referring to FIG. 10, a connecting link 27 having an engaging rod 29 is connected to another band (not shown).

Method of coupling the buckle is as follows.

The cover plate 24 is inserted into an opening behind the engaging rod 29 of the connecting link 27, and is rotated about a connecting portion 24*a*. The engaging plate 25 is inserted into an opening 26*a* of the frame member 26. The downward slant 25*a* of the engaging plate 25 engages with the locking portion 22*a* of the first operation member 22 so that the operating member 22 is inwardly moved. When the slant 25*a* passes the lock portion 22*a*, the operating member 22 is returned to the home position by the elastic force of the spring 28. Thus, the lock portion 22*a* engages with the hook portion 25*b*.

In operation for disengaging the buckle, the operating members 22 and 23 are pushed at the same time to release the lock portion 22*a* from the hook portion 25*b*, while the upward slant 23*a* of the second operating member 23 pushes the downward slant 25*a* of the engaging plate upward, so that the cover plate 24 is pushed up. The released cover plate 24 is rotated about the connecting portion 24*a* and removed from the connecting link 27.

In such a buckle, the cover plate must be rotated by fingers in order to release it from the engaging member 20. In other words, the releasing operation is complicated.

On the other hand, it may occur that the cover plate 24 is accidentally released, if the operating members 22 is pushed. In order to prevent the accident, the spherical projection 25*c* is provided on the engaging plate 25 as an additional locking structure. The projection 25*c* is adapted to abut on the periphery of the opening 26*a* when the hook portion 25*b* engages with the lock portion 22*a*. Thus, the cover plate 24 is prevented from releasing. In such a device, it is necessary to ensure a constant engaging force of the projection 25*c* against the periphery of the opening 26*a*. However, the projection 25*c* wears with time to reduce the engaging force, which may cause the releasing of the cover plate.

SUMMARY OF THE INVENTION

An object of the present invention is to provide a buckle for watch bands in which a cover plate is not accidentally released.

Another object of the invention is to provide a buckle in which the cover plate is easily released only by pushing both push plates at the same time.

According to the present invention, there is provided a buckle for a watch band having a first band member and a second band member having an engaging rod comprising a housing having a second opening at an upper portion and connected to the first band member, a pair of push plates provided in the housing so as to be moved in the lateral direction, each of the push plates having an engaging hook, spring means for urging each of the push plates in an outward direction, stopping means for stopping each of the push plates urged by the spring means at a position where an outer end of the push plate is projected from the housing, a cover pivotally connected to an end of the housing, a lock pin secured to an underside of the cover.

The cover is provided such that it is inserted into a first opening behind the engaging rod and turned onto the housing and that the lock pin is inserted into the second opening and engaged with the hooks of the push plates.

An opening spring is provided between the housing and the cover for urging the cover to an open position.

In a feature of the present invention the cover is connected to the housing by connecting means comprising a connecting member formed on the housing and a pin rotatably mounted in the connecting member and connected to the cover, and the opening spring is disposed between the connecting member and the pin. The push plates are disposed in symmetry with respect to a point.

These and other objects and features of the present invention will become more apparent from the following detailed description with reference to the accompanying drawings.

DETAILED DESCRIPTION OF THE PREFERRED EMBODIMENTS

Figure 1:
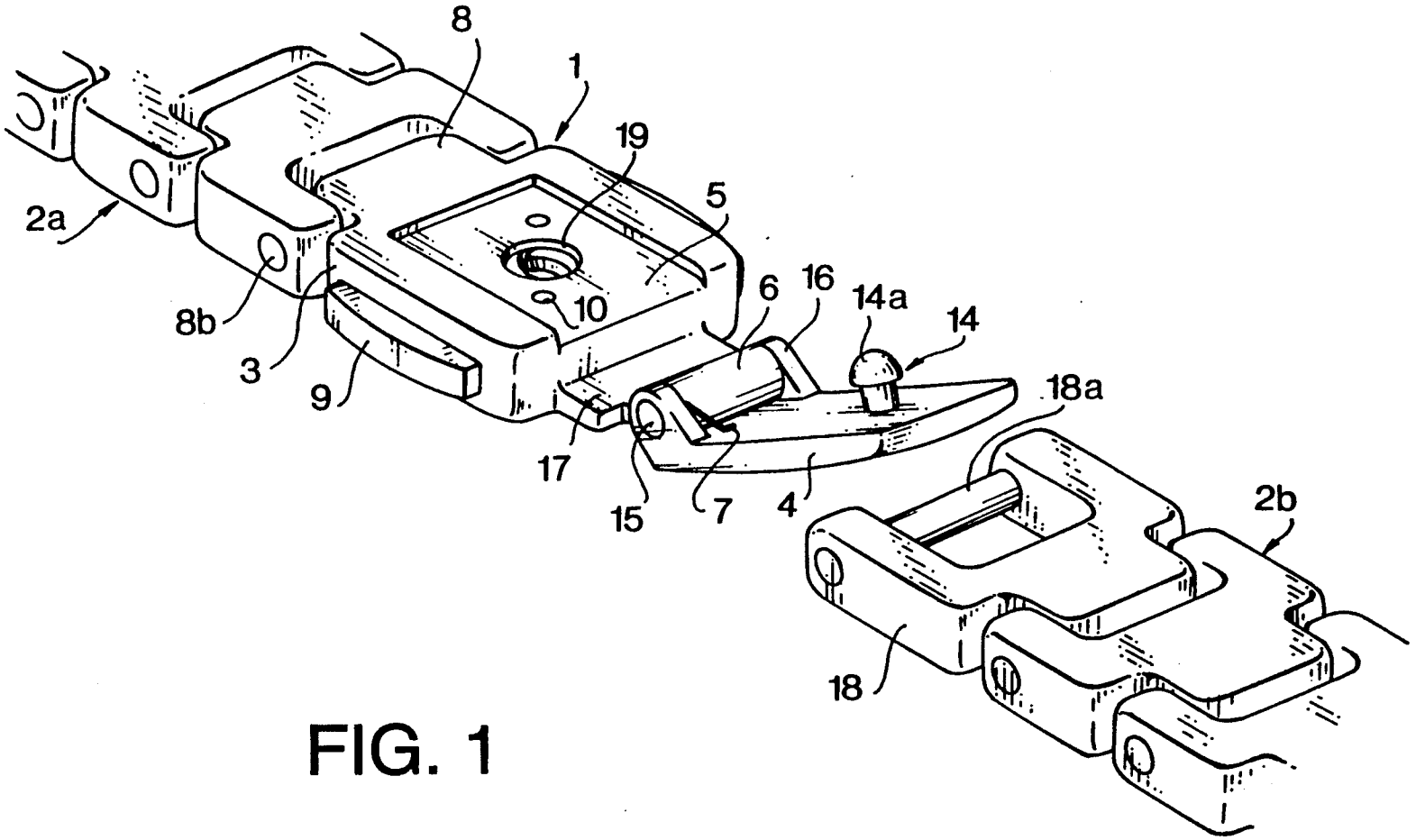
FIG. 1 is a perspective view showing a buckle for a watch band as a first embodiment according to the present invention.
Figure 2:
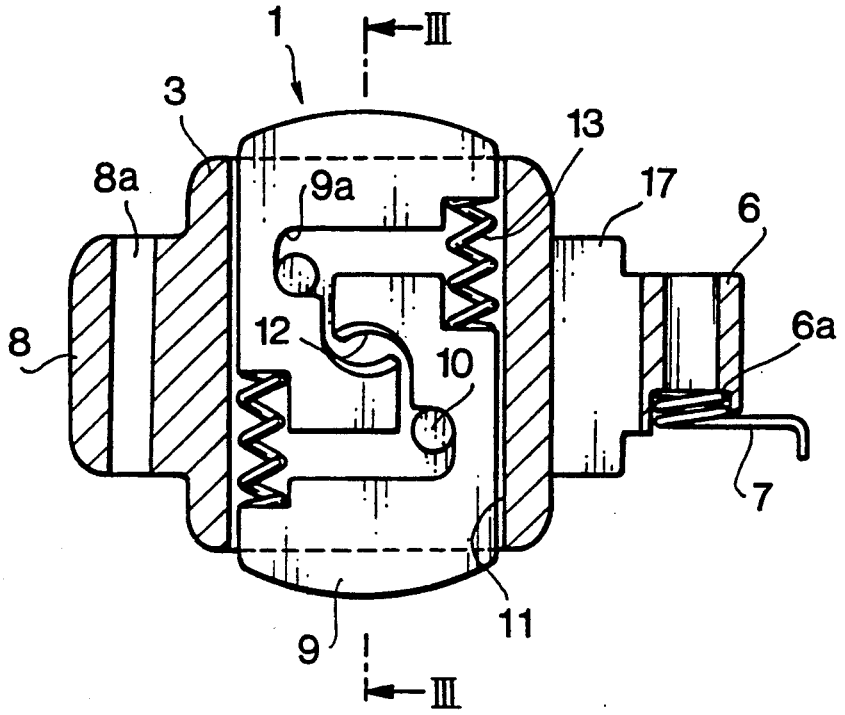
FIG. 2 is a sectional plan view showing a main part of the buckle.

Referring to FIGS. 1 and 2, a buckle 1 of the present invention comprises a housing 3 pivotally connected to an end of a first band member 2a of a watch band, and a cover 4 pivotally mounted on an end of the housing 3.

The housing 3 is made of a solid metal plate and comprises an upper frame 5 having an opening 19 and slightly indented from the upper surface of the housing to be engaged with the cover 4, a lateral housing space 11 formed under the upper frame 5, a connecting projection 8 projected from a base end of the housing, an engaging portion 17 projected from a lower portion of the upper frame 5 opposite to the connecting projection 8, and a cylindrical connecting member 6 formed on an end of the engaging portion 17. The connecting projection 8 has a lateral hole 8a in which a pin 8b is inserted to connect with the first band member 2a.

Figure 3:
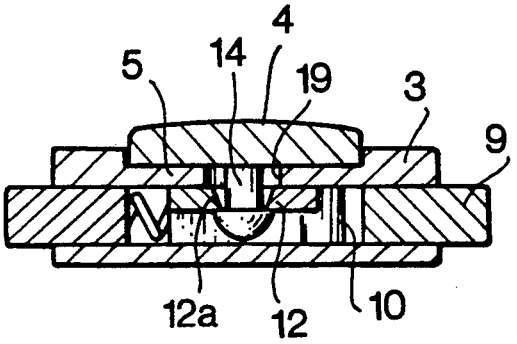
FIG. 3 is a sectional side view of the buckle taken along a line III—III of FIG. 2.

A pair of push plates 9 are slidably mounted in the housing space 11 so as to be moved in the lateral direction with respect to the longitudinal direction of the band. The push plates 9 are the same in configuration and are disposed in symmetry with respect to a point of a center of the housing space 11. Each push plate 9 comprises an engaging hook 12 having a semi-circular shape and an upward slant 12a (FIG. 3). The engaging hooks 12 are disposed opposite to each other and provided corresponding to the opening 19 of the upper frame 5. Between the push plates 9, a pair of return springs 13 are provided on both sides with respect to the longitudinal direction and disposed in point symmetry so as to outwardly urge the push plates.

The push plates 9 and the springs 13 are assembled in plane as shown in FIG. 2 and inserted into the housing space 11 from a side of the housing 3. After inserting of the push plates 9 and the springs 13, a pair of stopper pins 10 are pressed into holes formed in the housing, so that the stopper pins 10 are engaged with grooves 9a formed in the corresponding push plates 9. Each of the push plates 9 is stopped by the stopper pin 10 at a position where an end of the push plate is projected from the housing 3. Thus, the push plates are prevented from removing from the housing 3.

A coil spring 7 is engaged in a large diameter hole 6a formed in the connecting member 6 as shown in FIG. 2. An inner end of the spring 7 is fixed to the member 6.

The cover 4 is also made of solid metal plate and comprises a lock pin 14 securely mounted on the underside of the cover, and having a conical head 14a corresponding to the opening 19 of the upper frame 5, and a pair of connecting lugs 16 provided opposite to the lock pin 14. A pin 15 is inserted in holes of the connecting lugs 16 and the connecting member 6, so that the cover 4 is pivotally connected with the housing 3. An outside end of the spring 7 is projected from the connecting member 6 through a slit and abutted on the underside of the cover 4. Thus, the cover 4 is outwardly urged by the spring 7 to be opened as shown in FIG. 1.

A connecting link 18 connected to a second band member 2b of the watch band has an engaging rod 18a laterally provided on an end of the link.

Method of coupling the buckle will be described hereinafter.

The cover 4 is inserted into an opening behind the engaging rod 18a from the underside of the connecting link 18. The engaging rod 18a is put on the engaging portion 17 of the housing 3 and the cover 4 is rotated about the pin 15 over the engaging rod 18a. The cover 4 is pushed to abut on the upper frame 5 so that the lock pin 14 is inserted into the opening 19 of the upper frame. The conical head 14a of the lock pin 14 engages with the engaging hooks 12 of the respective push plates 9 to outwardly push the engaging hooks against the elastic force of the springs 13. When the conical head 14a passes the engaging hooks 12, the engaging hooks are returned by the springs 13 and engaged with a stem of the lock pin 14. Thus, the cover 4 is locked by the push plates 9 of the housing 3 as shown in FIG. 3.

In order to disengage the buckle 1, the push plates 9 are pushed at the same time so that the engaging hooks 12 are opened to disengage the lock pin 14. Since the end of the spring 7 is abutted on the underside of the cover 4 so as to urge it in the upward direction, the cover 4 is automatically opened. Thereafter, the engaging rod 18a is removed from the engaging portion 17. Thus, the connecting link 18 is disconnected from the buckle 1.

In the embodiment, if one of the push plates 9 is accidentally pushed in the locked state, the other push plate is still engaged with lock pin so that the cover maintains the engaging state. Consequently, the buckle having a simple construction is provided without an auxiliary keeping means The cover is automatically opened by the spring 7. Thus, the buckle can be easily disconnected.

Figure 11:
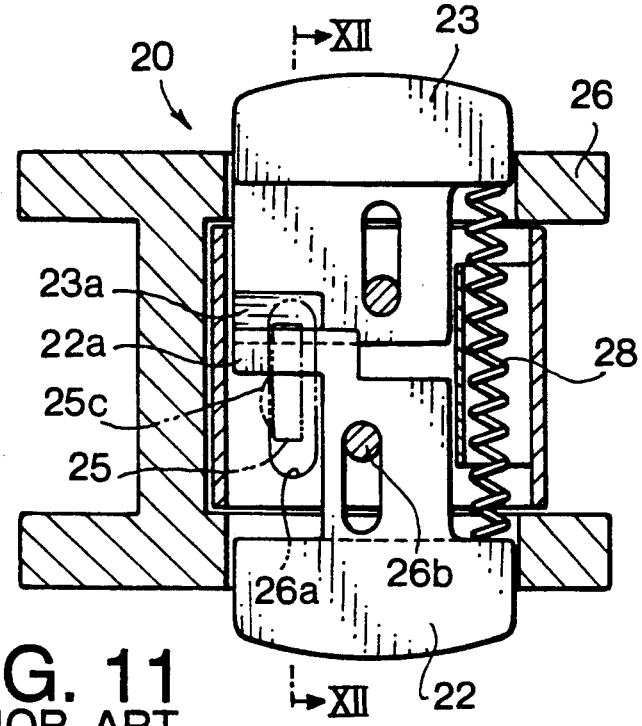
FIG. 11 PRIOR ART
FIG. 11 is a sectional plan view of the conventional buckle.
Figure 12:
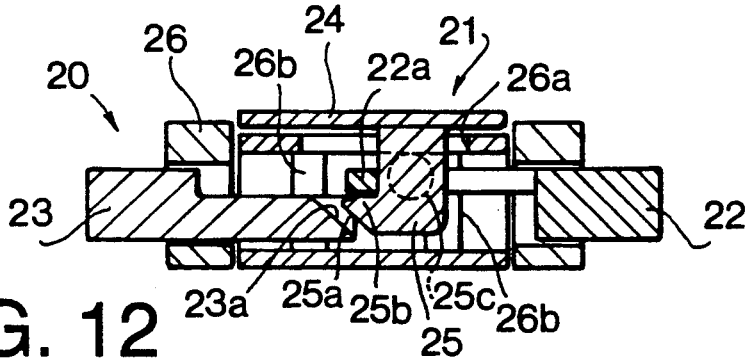
FIG. 12 PRIOR ART
FIG. 12 is a sectional side view of the buckle taken along a line XII—XII of FIG. 11.

The conical head 14a of the lock pin 14 has a larger contacting surface for the push plates 9, compared with the engaging plate 25 of FIG. 11. Therefore, the head will wear well and is not deformed. The conical head ensures the contact with the engaging hooks 12 of the push plates 9, even if the axis of the conical head is deviated from the center of the buckle in some extent. This makes it possible to easily manufacture the buckle.

The construction of the point symmetry disposition of the springs 13 has a function causing the push plates 9 to locate at a proper neutral position Consequently, the push plates are smoothly moved without deflecting.

Furthermore, the stopper pins 10 are disposed within a range of the push plates 9. Thus, the buckle can be made small size.

The spring 7 for opening the cover is mounted in the connecting member 6. Therefore, fingers of the wearer of the watch are prevented from touching the spring. The appearance of the buckle is not affected by the spring.

Figure 4:
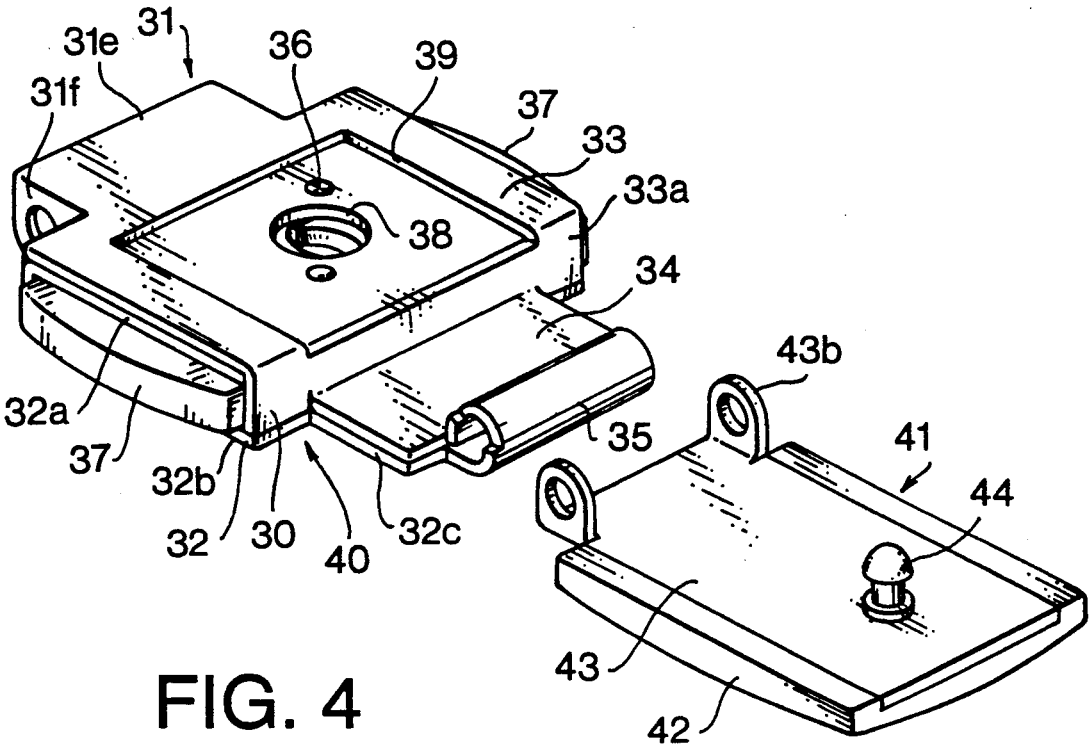
FIG. 4 is an exploded perspective view showing a main part of a buckle of a second embodiment of the present invention.

Referring to FIG. 4 showing the second embodiment, a buckle 40 of the second embodiment has a housing 30 comprising a housing body 32 and a cover frame member 33, each of which is formed by bending a metal plate. A cover 41 is pivotally engaged with the housing 30.

The cover frame member 33 has a rectangular window 39, and a connecting projection 31 formed on a base end portion which is to be connected to an end of a band (not shown) through a pin. Another end portion of the cover frame member 33 is downwardly bent to form a vertical wall portion 33*a*, and an engaging portion 34 is horizontally projected from the vertical wall portion 33*a* opposite to the connecting projection. The connecting projection 31 of the embodiment comprises an overhang 31*e* and a pair of connecting lugs 31*f* formed opposite sides of the overhang and having holes for the connecting pin.

Figure 5:
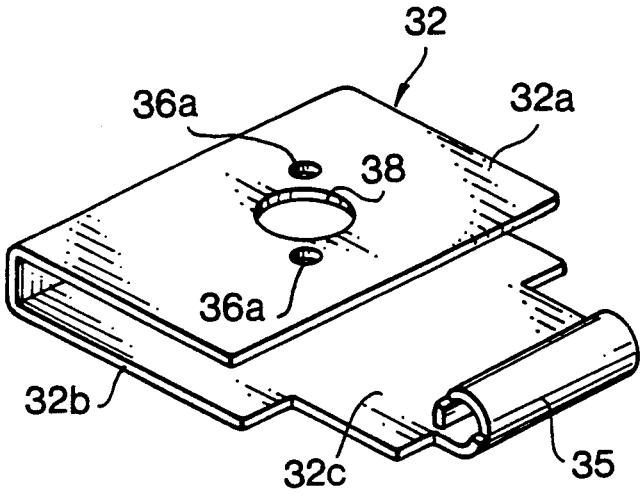
FIG. 5 is a perspective view of a housing body.

Referring to FIG. 5, the housing body 32 comprises an upper plate 32*a* and a lower plate 32*b* which are formed by bending in parallel with each other to form a U-shaped housing member. The upper plate 32*a* has an opening 38 and a pair of holes 36*a* for stopper pins 36. The lower plate 32*b* is elongated from the front end in the longitudinal direction with respect to the band so that a base plate 32*c* is formed. The base plate 32*c* has the same width as the engaging projection 34, and a cylindrical connecting member 35 is formed on a front end of the base plate 32*c*.

Referring to FIG. 4, in assembling the housing 30, the cover frame member 33 is mounted on the upper plate 32*a* of the housing body 32, while the engaging portion 34 is mounted on the base plate 32*c* and the lower periphery of the vertical wall portion 33*a* is put on the lower plate 32*b*. The cover frame member 33 is secured to the housing body 32 by welding, soldering or staking such that the opening 38 is exposed from the window 39. Thus, the housing space is defined by the housing body 32 and the cover frame member 33.

A pair of push plates 37 and springs (not shown) which are the same as those of the first embodiment are slidably mounted in the housing body 32 between the upper and lower plates 32*a* and 32*b*. The push plates 37 are stopped by stopper pins 36 in the same manner as the first embodiment.

Figure 6:
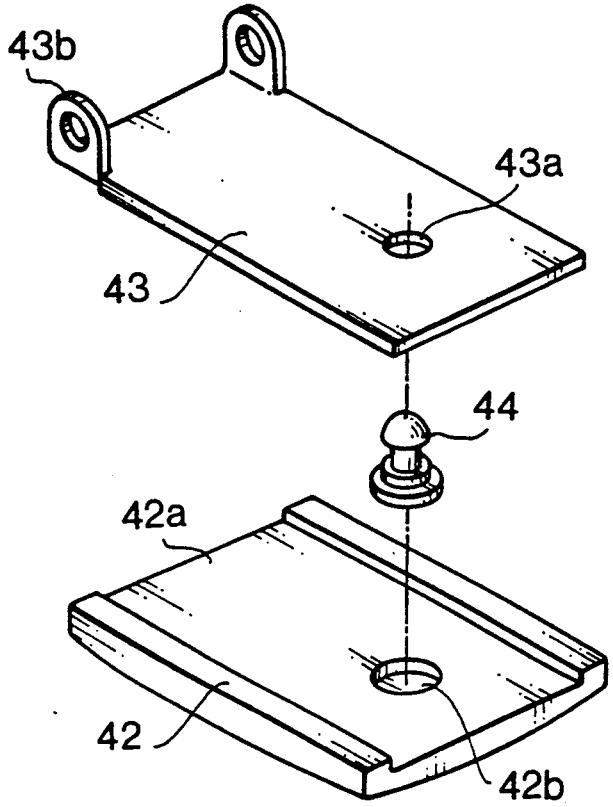
FIG. 6 is an exploded perspective view of a cover of the second embodiment.

Referring to FIG. 6, &he cover 41 comprises an outer plate 42 and an inner plate 43. The outer plate 42 has a U-shaped cross section, and is made by cutting a metal plate. A groove 42*a* is formed over the underside of the outer plate 42 in the longitudinal direction by cutting, and a round recess 42*b* is formed in the bottom of the groove 42*a* corresponding to the opening 38 of the housing 33. The inner plate 43 has an opening 43*a* formed corresponding to the recess 42*b* and a pair of connecting lugs 43*b* formed on an end of the inner plate by bending the plate. The diameter of the opening 43*a* is slightly smaller than that of the recess 42*b*. A lock pin 44 has a conical head 44*a* and a base 44*b* comprising a large diameter portion and a small diameter portion.

Figure 7:
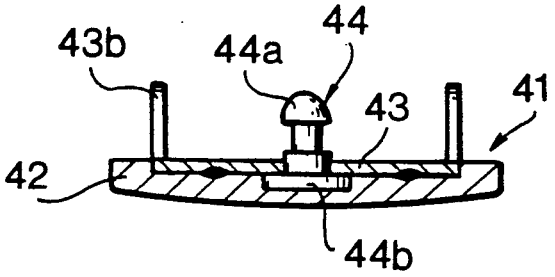
FIG. 7 is a sectional view of the cover.

In assembling the cover 41, as shown in FIG. 7, the large diameter portion of the base 44*b* of the lock pin 44 is engaged with the recess 42*b*. The inner plate 43 is engaged with groove 42*a*, while the small diameter portion of the lock pin 44 is inserted into the opening 43*a*. The inner plate 43 is welded to the groove 42*a* so that the lock pin 44 is secured to the cover 41 by the inner plate 43.

The connecting lugs 43*b* of the inner plate are rotatably connected with the connecting member 35 of the housing 30 through a pin. Thus, the buckle 40 is assembled. Similar to the first embodiment, a coil spring (not shown) is provided in the connecting member 35 so as to urge the cover in the releasing direction.

Figure 8:
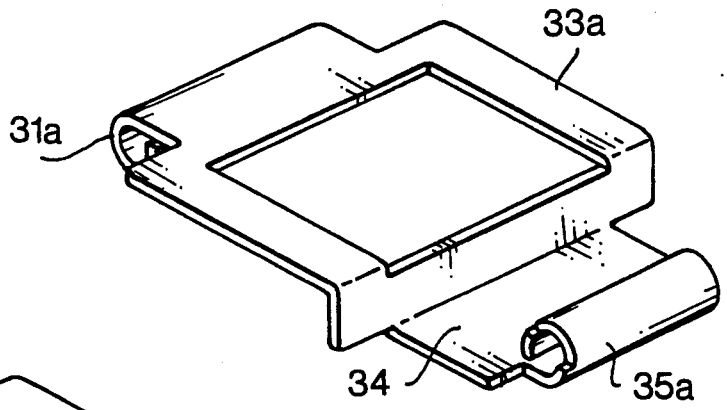
FIG. 8 is a perspective view showing a modification of an upper frame member of the buckle of the second embodiment.

FIG. 8 shows a modification of the cover frame member 33. A connecting projection 31*a* in the form of a cylindrical member is formed at the band connecting side, and a cylindrical connecting member 35*a* is formed on an end of the engaging portion 34.

It will be seen that the connecting member can be formed either on the housing body 32 and the cover frame member 33.

Figure 9A:
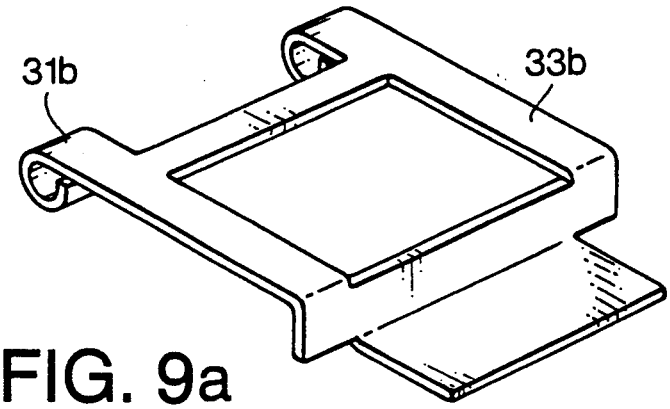
FIGS. 9a, 9b and 9c show further modifications of the upper frame member, respectively.
Figure 9B:
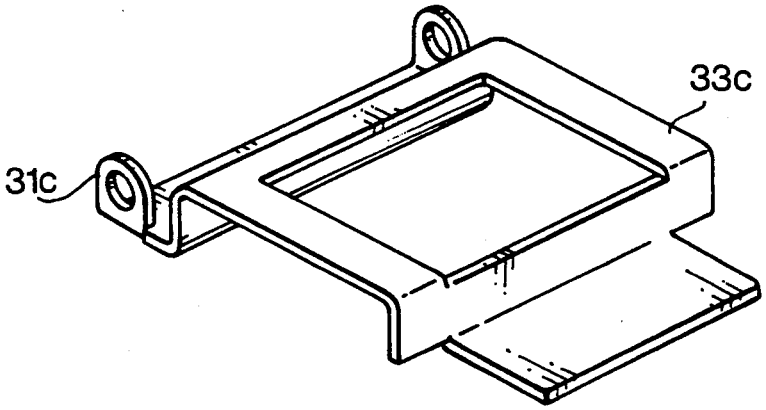
Figure 9C:
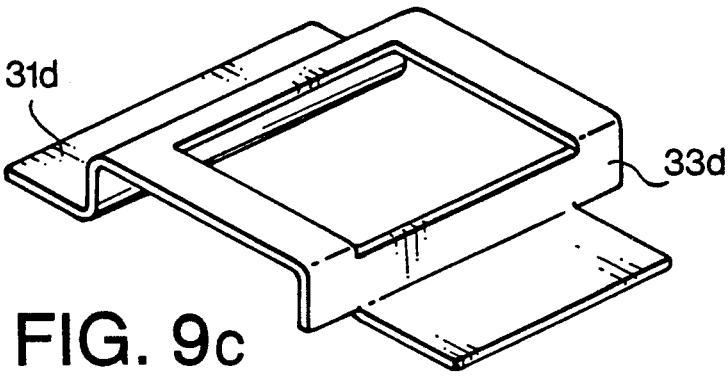
Figure 10:
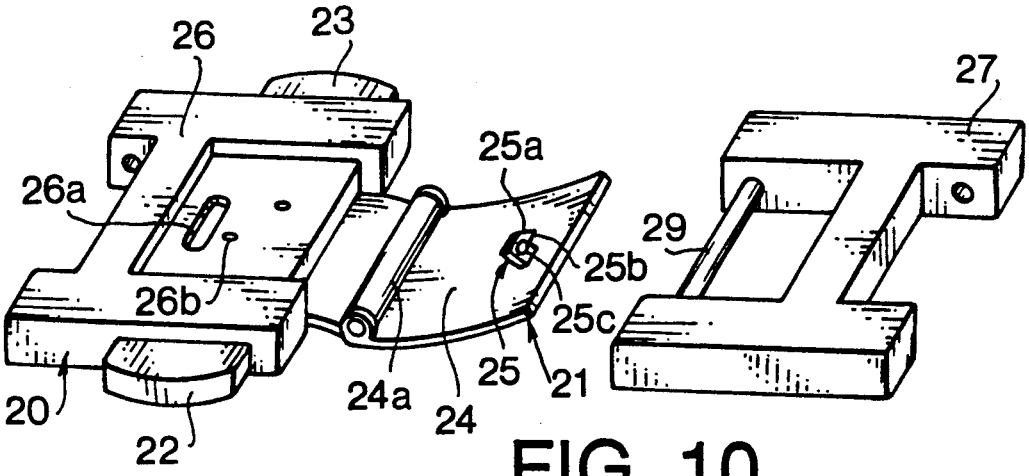
FIG. 10 PRIOR ART
FIG. 10 is a perspective view of a conventional buckle.

Referring to FIGS. 9*a*, 9*b* and 9*c*, the connecting projection 31 is further modified in dependency on the design of the band. As shown in FIG. 9*a*, a connecting projection 31*b* comprises a pair of cylindrical connecting portions, defining a notch there-between to which an end of a band is connected. A pair of connecting projections 31*c* of FIG. 9*b* is provided on an end of downward bent portion of the cover frame member 33. A connecting projection 31*d* of FIG. 9*c* is also provided on an end of the downward bent portion in the form of a flat plate. The connecting projection 31*d* is welded to an end link of the band.

In the second embodiment, since parts of the housing and the cover of solid metal plate are separately made by bending metal plates, the buckle can be easily manufactured with a low cost. The lock pin can be easily secured to the outer plate by welding the inner plate with the outer plate.

While the invention has been described in conjunction with preferred specific embodiments thereof, it will be understood that these descriptions are intended to illustrate and not limit the scope of the invention, which is defined by the following claims.

What is claimed is:

1. A buckle for a watch band having a first band member and a second band member having an engaging rod which is provided at an end link of the second band member, the engaging rod disposed in a lateral direction with respect to a longitudinal direction of said watch band, the engaging rod being disposed so as to form a first opening between it and the end link, comprising:

a housing having a second opening at an upper portion and connected to said first band member;

a pair of push plates provided in the housing so as to be moved in said lateral direction;

each of said push plates having an engaging hook;

spring means for urging each of said push plates in an outward direction;

stopping means for stopping each of said push plates urged by said spring means at a position where an outer end of the push plate is projected from the housing;

a cover pivotally connected to an end of said housing;

a lock pin secured to the underside of said cover;

said cover being provided such that it is inserted into said first opening behind said engaging rod and turned onto said housing and that said lock pin is inserted into said second opening and engaged with said engaging hooks of said push plates;

each of said push plates being formed such that the engaging hook is removed from the lock pin only when that push plate is pushed;

an opening spring provided between said housing and said cover for urging the cover to an open position.

2. The buckle according to claim 1 wherein said cover is connected to the housing by connecting means comprising a connecting member formed on said housing and a pin rotatably mounted in the connecting member and connected to the cover, said opening spring is disposed between the connecting member and the pin.

3. The buckle according to claim 1 wherein said lock pin has a conical head at a top thereof.

4. The buckle according to claim 1 wherein said push plates are disposed in symmetry with respect to a point.

5. The buckle according to claim 1 wherein said stopping means comprises a pair of stopper pins secured to the housing and each stopper pin is disposed so as to be engaged with a groove formed on a side of the push plate.

6. The buckle according to claim 1 wherein said opening spring is a coil spring.

7. The buckle according to claim 1 wherein said spring means comprises a pair of return springs which are disposed in symmetry with respect to a point.

8. The buckle according to claim 1 wherein said housing comprises bend metal plates which are engaged with each other.

9. The buckle according to claim 1 wherein said cover comprises a pair of plates which are engaged with each other.

* * * * *